United States Patent [19]

Spademan

[11] 4,447,968

[45] May 15, 1984

[54] MULTIDIRECTIONAL DYNAMIC FITTING SYSTEM FOR SPORT SHOE

[76] Inventor: Richard G. Spademan, 130 Country Club Dr. #30, Incline Village, Nev. 89450

[21] Appl. No.: 283,862

[22] Filed: Jul. 16, 1981

[51] Int. Cl.[3] ..... A43B 23/02; A43B 5/04

[52] U.S. Cl. ..... 36/109; 36/119

[58] Field of Search ..... 36/114, 109, 118, 119

[56] References Cited

U.S. PATENT DOCUMENTS

| | | | |
|---|---|---|---|
| 4,196,530 | 4/1980 | Delery | 36/119 |
| 4,222,184 | 9/1980 | Kastinger | 36/118 |
| 4,338,735 | 7/1982 | Spademan | 36/119 |

*Primary Examiner*—Patrick D. Lawson

*Attorney, Agent, or Firm*—Townsend and Townsend

[57] ABSTRACT

A shoe such as a running shoe is disclosed which fits comfortably on the foot of the wearer during most time and which includes a sensor such as a bar movably attached to the shoe for increasing the tightness of the fit when the foot is moved relative to the lower leg in a plurality of directions from a normal position to positions relative in which greater forces are expected to be exerted by the user. Typically, the increase in forces is achieved by placing a movable insert in the shoe which is connected with the sensor via a cable. In a simplified form, the sensor is constructed so as to tighten a portion of the shoe against the foot to increase tightness of the fit.

45 Claims, 10 Drawing Figures

ROTATED
(APPROXIMATELY 10°)

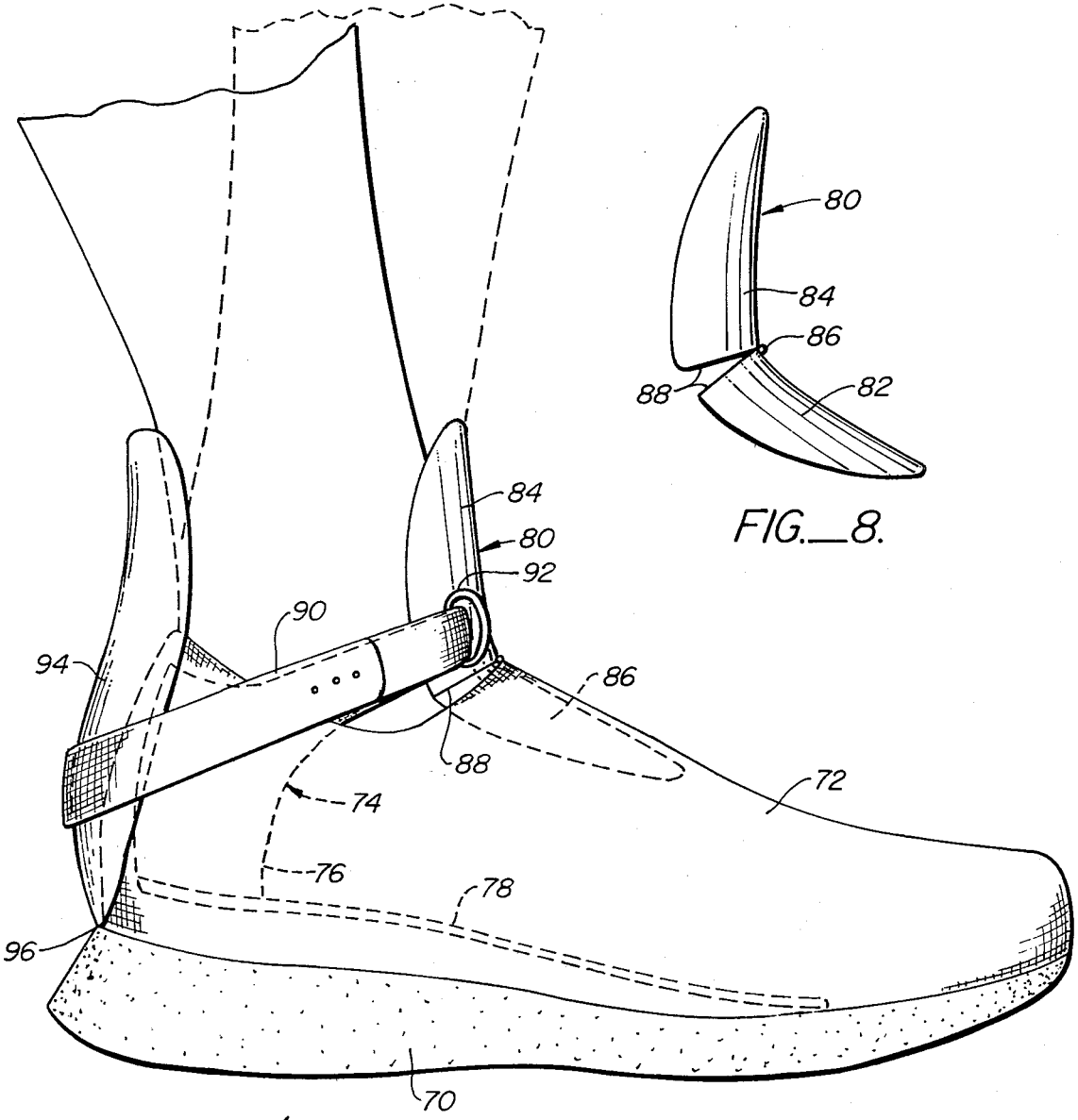
FIG._7.
FIG._8.
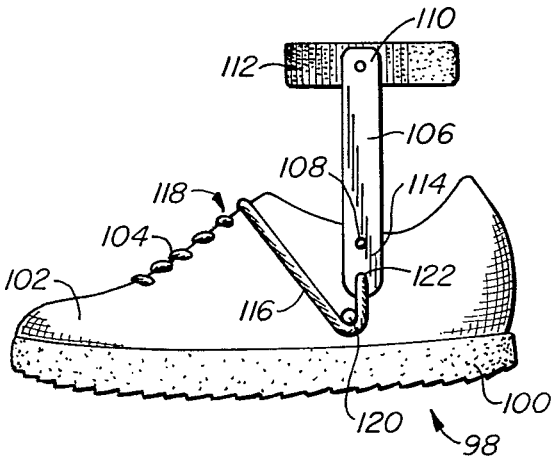
FIG._9.
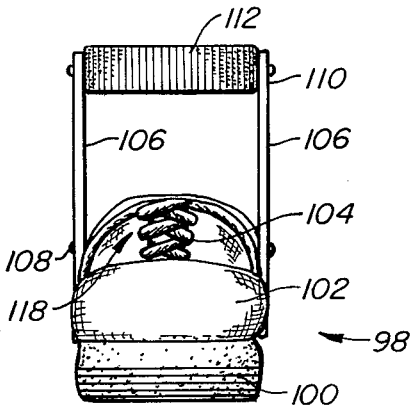
FIG._10.

MULTIDIRECTIONAL DYNAMIC FITTING SYSTEM FOR SPORT SHOE

BACKGROUND OF THE INVENTION

Sport shoes such as running, tennis or soccer shoes, as well as skates, ski boots and the like must fit tightly on the user's foot. During certain maneuvers, with a running shoe during heel strike and toe off, for example, the tightness of the fit needs to be greater than during other times when the forces transmitted between the foot and the ground via the shoe are not as severe. In the past, it was typical to tighten the shoe as much as possible, and physically bearable, to prevent or at least minimize relative movement of the foot in the shoe at times when maximum forces were transmitted between the foot and the shoe. As a practical matter, such a fit is excessively tight during most other times and quite frequently is uncomfortable, can lead to numbness and, in extreme cases, can even result in injuries. Thus, a compromise is frequently reached by tightening the shoe on the foot more than is necessary for the small forces that are applied and less than is desired to prevent relative movement of the foot in the shoe when large forces are applied. Consequently, the fit of such shoes is almost always other than what it should be.

This problem has been recognized in the past in connection with ski boots where the exerted forces are especially large and required tightness of the fit for extreme maneuvers is typically unbearable for any length of time. Thus, this inventor has developed dynamic fitting systems which temporarily increase the tightness of the fit of the boot on the foot in response to certain skiing maneuvers, for example, by constructing the ski boot so that the tightness of the fit of the boot, or of at least a portion of the boot increases in response to a forward lean of the skier. U.S. patent application Ser. No. 109,611, filed Jan. 4, 1980, entitled A SPORT SHOE WITH A DYNAMIC ADJUSTABLE CUFF ASSEMBLY, now U.S. Pat. No. 4,360,979, and U.S. patent application Ser. No. 274,031, filed June 15, 1981, entitled A DYNAMIC INTERNAL FITTING SYSTEM FOR A SPORT SHOE, now U.S. Pat. No. 4,338,735, describe such dynamic fitting systems.

In many respects, ski boots present a particular problem because it is one of their objectives to significantly limit the mobility of the user's ankle joint. For practical purposes, the skier's leg is movable in only a forward direction and even this movement is greatly limited when compared with the anatomical freedom of movement provided by the ankle joint. Further, ski boots are large, relatively bulky and have thick walls to provide the desired strength, rigidity and heat insulation. Consequently, there is ample space within which to build a system to tighten the boot in response to a particular movement, e.g. forward lean.

Up to now, little or no consideration has been given to the relative tightness of sport shoes particularly lightweight, highly mobile sport shoes such as running, tennis, soccer shoes and the like. The lightness of such sport shoes and the lack of an adequate analysis of the interaction between the sport shoe and the user's foot led to the practice of simply tightening the shoe to suit the user's taste, feel or preference. In some instances, the shoe might be too loose and not infrequently, slipped off the foot in a particularly strenuous maneuver such as a fall, a sudden change in direction when running and the like. This was considered an inevitable adjunct to participating in sports.

Upon closer analysis, however, it becomes apparent that there are distinct phases in the use of a sport shoe when forces applied by the foot to the shoe momentarily greatly exceed the normally encountered forces. In running, for example, upon toe off, that is when the runner plantarflexes his foot and puts his weight on the forefoot just prior to lifting the foot off the ground, there are significant forces which tend to push the foot in a rearward direction relative to the shoe. Conversely, during heel strike, that is when the foot contacts the ground at the end of a stride, there are significant forces generated by both the runner's weight and the deceleration of the foot which tend to move the foot in a forward direction relative to the shoe. Such movements may be relatively small, say in the order of no more than a few millimeters but they are present and, typically, they are repeated thousands of times during a single run. This can lead to discomfort, skin irritation from rubbing between the foot and the shoe and energy losses which, though small, are highly undesirable, particularly in competitive sports. The problem is magnified in contact type team sports where the forces can be significantly greater than those encountered during running, for example. Up to now, no solution to this problem was available.

SUMMARY OF THE INVENTION

The present invention greatly reduces or eliminates relative movement between the foot and the sport shoe by increasing the tightness of the fit of the shoe on the foot as a function of foot movement away from a neutral, normally relaxed foot position relative to the user's leg or another portion of his lower extremity. At the same time, the tightness of the fit can be reduced when the foot is in its neutral position when minimum forces are exerted to prevent discomfort or possible injury from an overtightening of the shoe for excessive lengths of time. In particular, the present invention increases the tightness of the fit when the foot moves away from its neutral position irrespective of the direction in which it is moved. Typically, the tightness is increased when the foot pivots about the ankle joint, that is when the leg moves either forwardly or rearwardly with respect to the foot. However, the tightness of the fit can also be increased when the foot moves in other directions, e.g. when it pivots laterally about the ankle joint.

Broadly speaking, therefore, the present invention provides a sport shoe forming a comfortable close fit on the foot of the lower extremity when the foot is in a neutral position, e.g. when the foot is substantially perpendicular to the user's lower leg. The tightness of the fit is increased when the foot is moved into another position. This is accomplished with means for sensing a relative movement between the foot and the lower leg and means operatively coupled with the sensing means and the shoe for increasing the tightness of the fit of the shoe on the foot in response to a relative movement of the lower extremity when the foot moves in any one of a plurality of different directions away from its neutral position. This system can be directly incorporated in a sport shoe and in such an instance forms an integral part thereof. Alternatively, the system can be provided in the form of a kit that is adapted to be placed into a conventional sport shoe to convert such a shoe into one having the above discussed characteristics.

One aspect of the invention provides that the sensing means be defined by a bar and preferably a pair of cooperating, parallel bars which straddle the user's ankle joint and which have an upper end attached to the user's lower leg. Lower end portions of the bars are pivotally, preferably universally pivotally attached to the shoe so that movement of the foot about the ankle joint relative to the lower leg pivots the bars with respect to the shoe. A cable is attached to the lower end portions of the bars and to the shoe so that pivotal movement of the bar in opposite directions, e.g. in a forward or rearward direction or in opposing lateral directions increases the tightness of the shoe on the foot as a function of the extent to which the foot has moved away from its normal position.

In a running shoe, therefore, the tightness of the fit is increased both when the foot is plantarflexed or the lower leg is pivoted rearwardly, and when the foot is dorsiflexed or the lower leg is pivoted forwardly relative to the foot. Depending on the individual's running style, the plantarflexion and dorsiflexion of the foot may take place during different phases of both toe off and heel strike, or either one may occur during toe off or heel strike only. Consequently, during those moments when large forces are transmitted from the foot to the ground via the shoe the shoe fits the tightest, thereby reducing or eliminating movements of the foot in to the shoe.

Preferably, the cable operated by the bars is attached to an insert within the shoe which is defined by a heel cup that covers at least part of the heel of the user's foot and a footbed that extends forwardly from the heel cup to about the metatarsal phalangeal area or the ball of the user's foot. The footbed helps to anchor the insert in the shoe and for that purpose can either be flexible or rigid. By constructing it of rigid materials, it further acts as a movable foot bed which helps to press the user's forefoot and instep against the upper of the shoe to increase the tightness of the fit. For purposes of this application the term "rigid footbed" which forms part of the insert, means and is intended to mean, a footbed which has a rigidity that is about equal to or slightly greater than the rigidity of the shoe sole. This should be contrasted with the term "flexible footbed" which can also be attached to the insert but which is substantially more flexible than the shoe sole.

Other aspects of the present invention permit the adjustment of the cable relative to the shoe, the bars and the insert so as to adapt it for use with feet of differing sizes and further to enable one to select the "neutral position", that is the position at which the tightness with which the shoe engages the foot is least.

Also, the cable can be adjusted to allow for an adequate range of motion of the ankle joint. This permits the foot and shoe to form a stable platform for the user to make subtle changes in the center of gravity of his or her body and to allow mobility for sudden stops and starts, rapid acceleration and quick changes in direction. Further, the cable can be adjusted to limit ankle movement to optimum positions for maximum muscular strength and control.

To summarize, therefore, the present invention provides a multidirectional dynamic fitting system for sport shoes which allows selection of a "neutral" position for the foot with respect to a remainder of the lower extremity at which the tightness of the fit is at a minimum and which increases the tightness in response to movement of the foot away from the neutral position irrespective of the direction in which the foot is moved. This greatly enhances the utility of a sport shoe in that it is tightest on the foot when the foot is moved the furthest from the neutral position which typically is the position at which maximum forces are transmitted between the foot and the shoe. Due to the tightness of the fit relative movements between the foot and the shoe are minimized or eliminated. Yet, the discomfort and possibility of injury which would accompany the use of a shoe tightened to take into account maximum forces, which are encountered for only fractions of a second, are eliminated because when the foot is in its neutral position, or in a position which deviates therefrom by only a minor amount, the fit of the shoe can be such as to cause no discomfort whatsoever.

Aside from momentarily increasing the tightness with which the shoe fits on the wearer's foot, the fitting system of the present invention also absorbs shock and helps reduce the maximum forces to which the foot is subjected. This aspect of the present invention renders it particularly suitable for running shoes where during a single run the foot strikes the ground thousands of times, each time subjecting it to forces of a magnitude that may exceed the user's weight several times. This shock absorbing characteristic results from the relative lowering of the heel cup when the shoe touches the ground during heel strike as the foot moves towards its neutral position. Thus, when the shoe sole first strikes the ground the runner's heel is still spaced from the sole and it is permitted to decelerate over a significant distance as compared to the distance over which the foot must decelerate when in direct contact with the shoe sole. This greatly reduces the maximum force to which the foot and indeed the entire leg of the user, including his knee, which is particularly susceptible to injury from excessive impact forces, is subjected. In the past, impact forces during heel strike could only be lowered by making the shoe sole of a resiliently compressible material, such as closed cell foam. The extent to which the forces can be reduced in this manner, is severely limited because an undue resiliency in the shoe sole renders it uncomfortable and unstable. Moreover, the resiliency of the material is quickly lost due to permanent set in the material.

BRIEF DESCRIPTION OF THE DRAWINGS

FIG. 7 is a side view similar to FIG. 5 but shows the operation of the fitting system of the present invention when the user's lower leg is flexed forwardly or rearwardly;

FIG. 8 is an enlarged, detailed view of an instep tongue employed in the shoe shown in FIGS. 5–7;

FIG. 9 is a side elevational view of a shoe including a multidirectional dynamic fitting system constructed in accordance with another embodiment of the present invention; and FIG. 10 is a front end view of the shoe shown in FIG. 9.

DESCRIPTION OF THE PREFERRED EMBODIMENTS

Figure 2A:
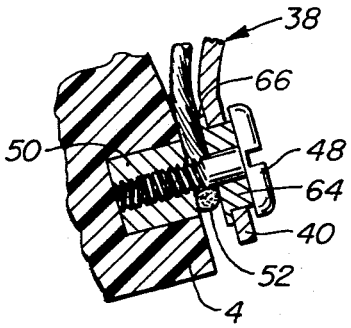
FIG. 2A is a fragmentary, enlarged cross-sectional view taken on line 2A—2A of FIG. 1.

Referring to FIGS. 1–4, a shoe 2 such as a running shoe has a sole 4 and an upper 6 secured to the sole and defining the inside of the shoe within which the user places his foot 8. The user's lower leg 10 extends upwardly from the shoe. The upper of the shoe includes a conventional, typically V-shaped cutout 12 above the fore foot and extending generally from about the instep 14 towards a front or toe end 16 of the shoe. A tongue 18 covers the cutout in a conventional manner and normally is secured to the upper in the vicinity of the toe end. The upper further defines a cuff 20 which is normally located below the user's ankle joint 22. Lastly, the upper terminates in a heel end 24 which surrounds and engages the user's heel.

Disposed within the shoe is an insert 26 which forms part of the multidirectional dynamic fitting system 28 of the present invention. The insert is defined by a heel cup 30 which is shaped to fit over the heel of the user's foot and which is disposed between the user's heel and the heel end 24. A footbed extends forwardly from the heel cup, rests on shoe sole 4 and terminates in the area of the ball 34 of the user's foot. Thus, in use the insert engages the heel of the user's foot and the underside of the foot from the heel to about the ball of the foot.

An actuator 36 defined by a pair of spaced apart, substantially rigid, elongated bars 38 straddle the user's ankle joint 22. Each bar has a lower end portion 40 pivotally attached to the shoe, as is further described below, and an upper end portion 42. A strap 44 is mounted thereto with a pivot pin 46 or the like permitting relative pivotal movements between the bar and the strap. The ends of the strap are fitted with an adjustable fastener such as snaps or a Velcro fastener so that it can be wrapped about the user's ankle and adjusted for use on ankles of differing sizes.

Figure 2:
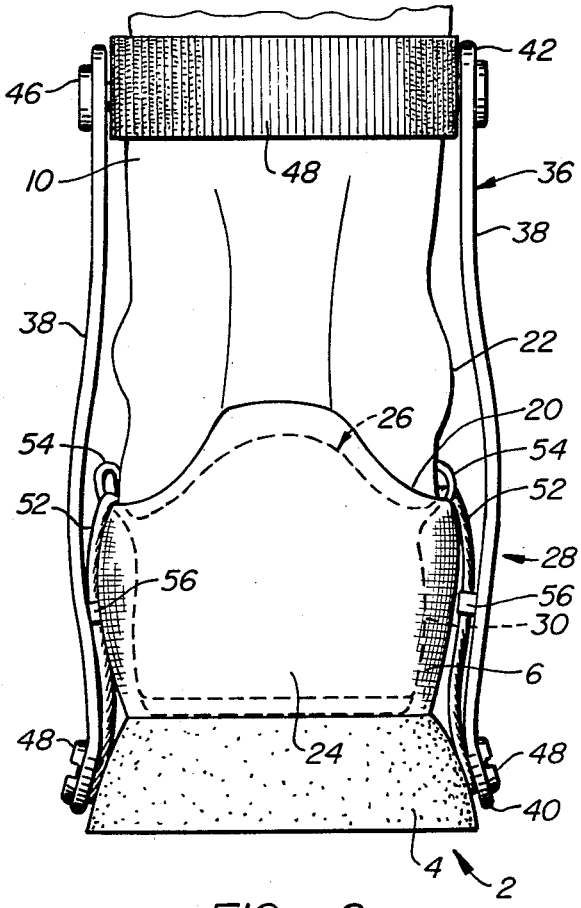
FIG. 2 is a rear end view of the shoe shown in FIG. 1.
Figure 1:
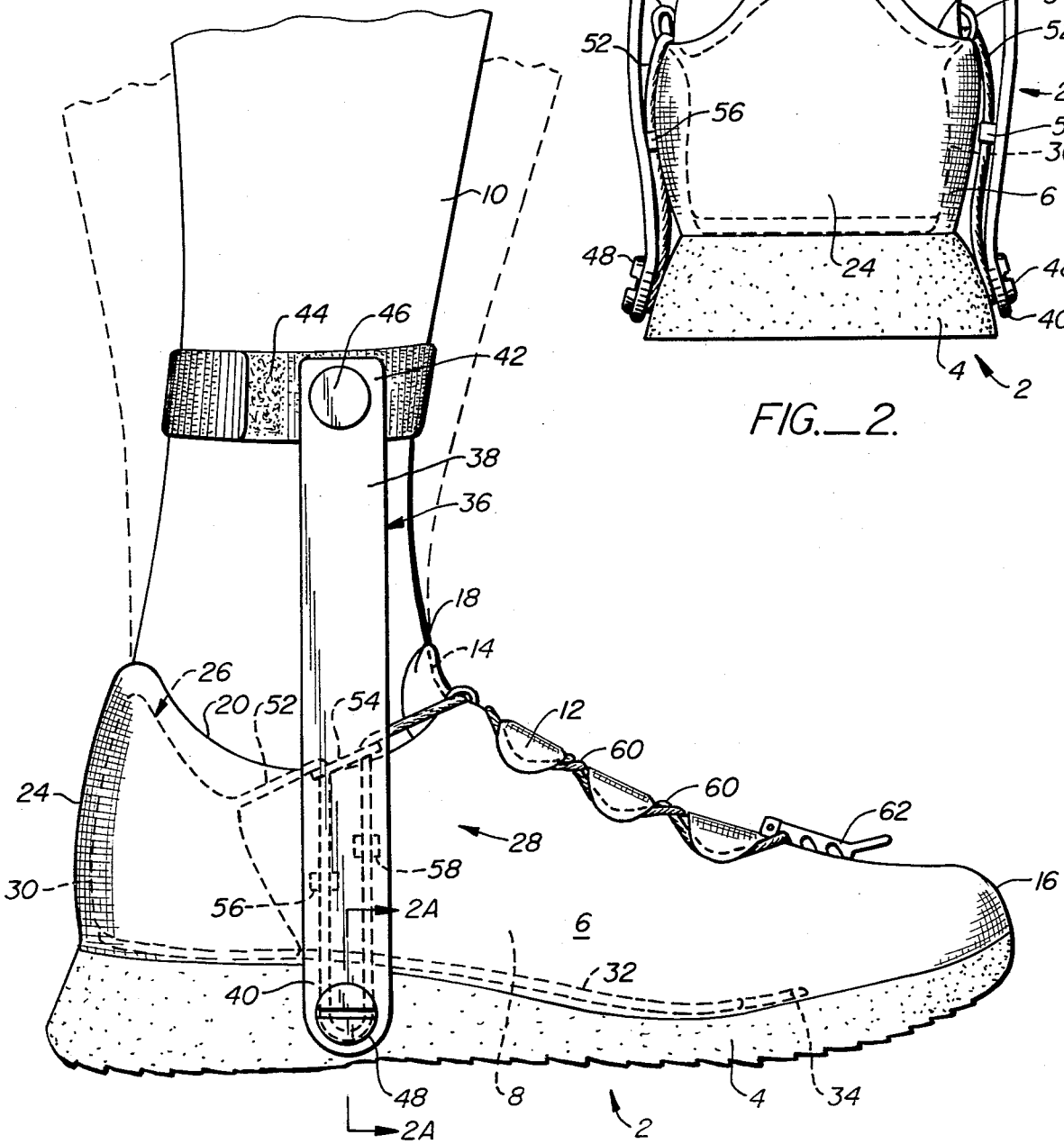
FIG. 1 is a side elevational view of a shoe provided with a multidirectional dynamic fitting system constructed in accordance with the present invention.
Figure 4:
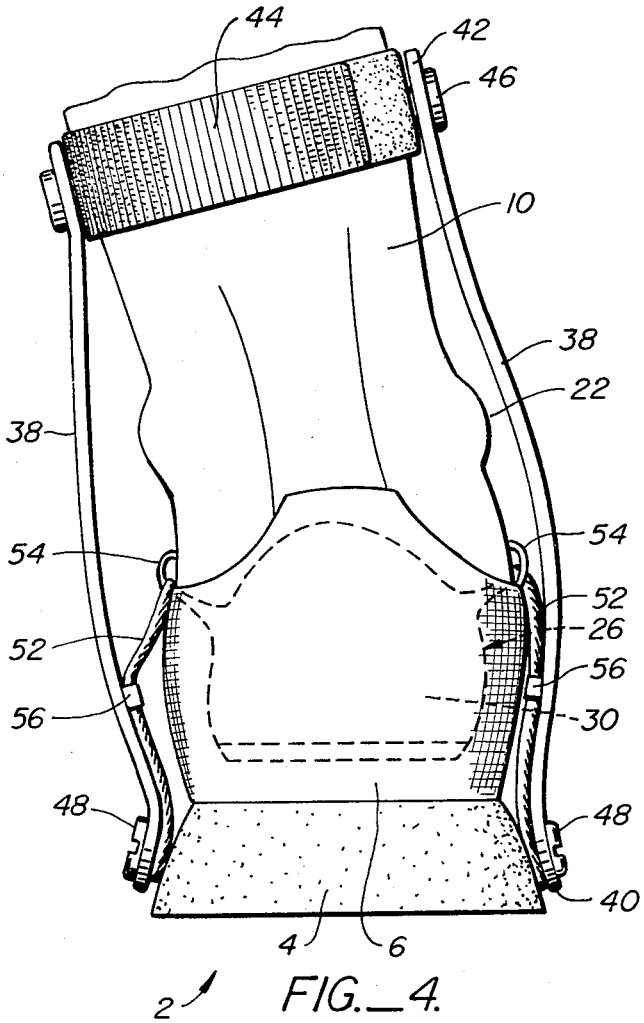
FIG. 4 is an end view similar to FIG. 2 but shows the foot flexed in a lateral direction about its ankle joint and the corresponding tightening of the fitting system resulting therefrom.

The lower end portion 40 of the bar is pivotally attached to the shoe sole 4 with a flathead bolt 48 or the like that is threaded into an insert 50 anchored in the sole so that the bars 38 can pivot in forward and rearward directions with the user's lower leg as is shown in FIG. 1. In addition, the bars can be pivoted laterally with respect to the ankle joint in opposing directions as is best illustrated in FIG. 4 because of the relative flexibility of the shoe sole 4 which allows corresponding movements of insert 50 and therewith of bolt 48. Alternatively a universally movable connection such as a balljoint (not shown) can be anchored in the sole to form the universally pivotable joint between the lower end portion 40 of the bars 38 and the shoe. For many, if not most purposes, however, the somewhat limited universally pivotable connection shown in FIGS. 2 and 2A is sufficient.

A cable 52 is connected, e.g. integrally constructed with the heel cup 30 and extends therefrom on each side of the user's foot in a generally forward and upwardly inclined direction to a ring guide 54 secured to each side of the cuff 20. From each ring guide, the cable extends downwardly past a first guide bushing 56 secured to the corresponding bar 38, is looped about bolt 48 and hence extends upwardly past a second guide bushing 58 back to the ring guide 54. From the ring guide, the cable extends forwardly over a series of closure guides or pulleys 60 arranged on each side and spaced over the length of the V-shaped cutout 12 in the upper 6 of the shoe to about the end of the cutout. An overcenter clamp 62 is secured to the upper in the vicinity of the toe end 16 which, when closed, pulls on the cable and thereby closes the V-shaped cutout and generally tightens the cable.

In use, a foot is initially placed inside the shoe, strap 44 is wrapped about the ankle and buckle 62 is closed to establish an initial "close fit" of the shoe on the foot and provide for an adequate range of motion of the ankle joint. Next, the position of foot and shoe which constitutes the "neutral" position, or other position selected to limit ankle movement to optimum position, is selected. With the foot in its neutral position, threaded bolt 48 is tightened until a bushing 64 clamps the portion of cable 52 looped about the bolt tight so that no further movement of the looped cable portion with respect to the shoe is possible. Bushing 64 has a periphery which fits into a corresponding bore in the lower portion 40 of the bar and a length slightly greater than the thickness of the bar so that the bar can freely pivot thereon when bolt 48 is tightened. A lip 66 on the bushing as well as the head of the bolt prevent the bar from slipping off the bushing.

The shoe is now ready for use. The closed buckle 62 generates a first force in cable 52 which is relatively low and which presses the heel cup 30 against the heel of the user's foot. Further, the closing of the buckle at least partially closes the V-shaped cutout 12 and thereby tightens the upper of the shoe over the foot. Adjustments in the tightness of the upper can be made by changing the slot of buckle 62 into which the cable is placed.

Figure 3:
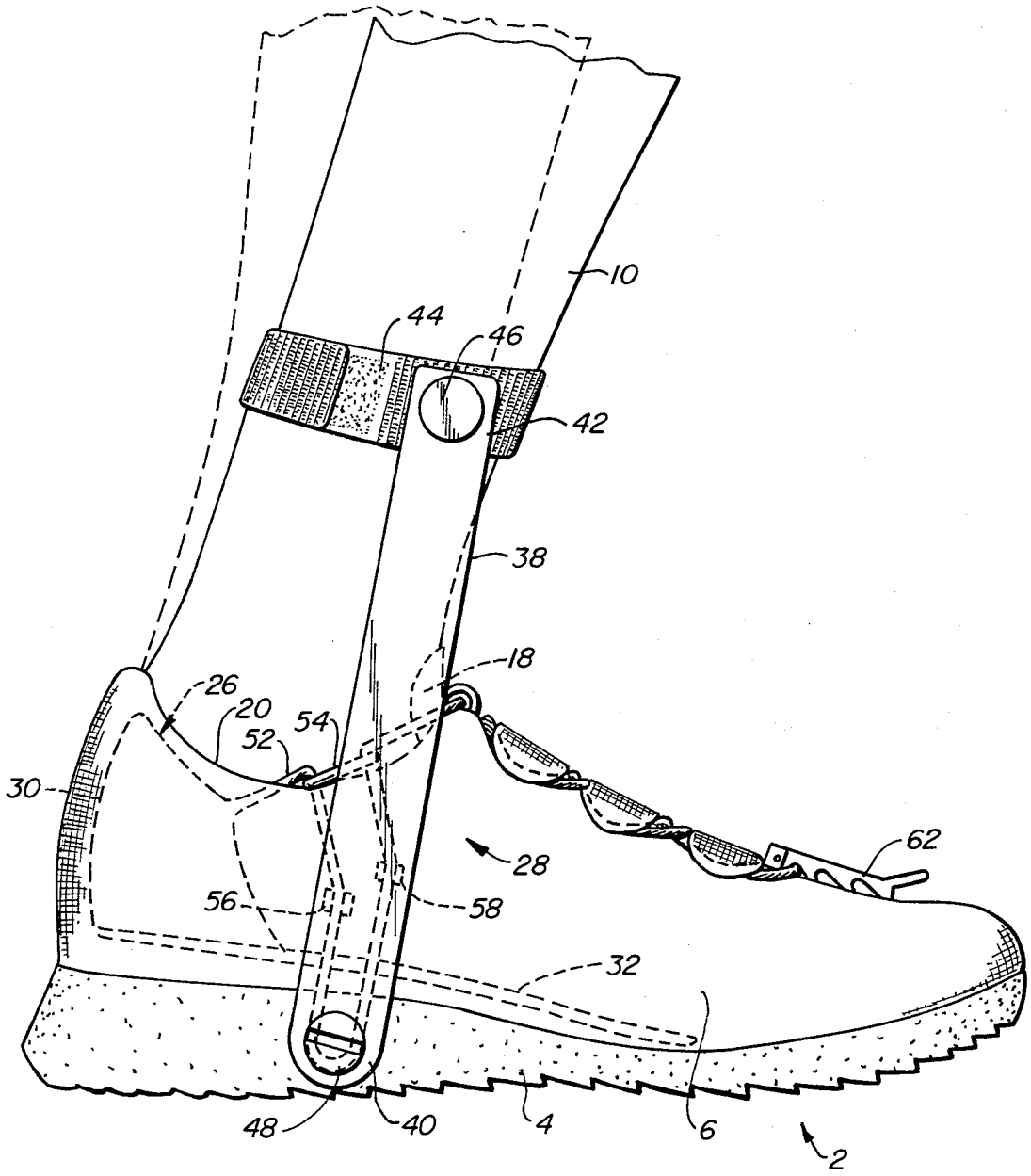
FIG. 3 is a view similar to FIG. 1 but shows the user's foot dorsiflexed with respect to his leg and the tightening of the fitting system resulting therefrom.
Figure 6:
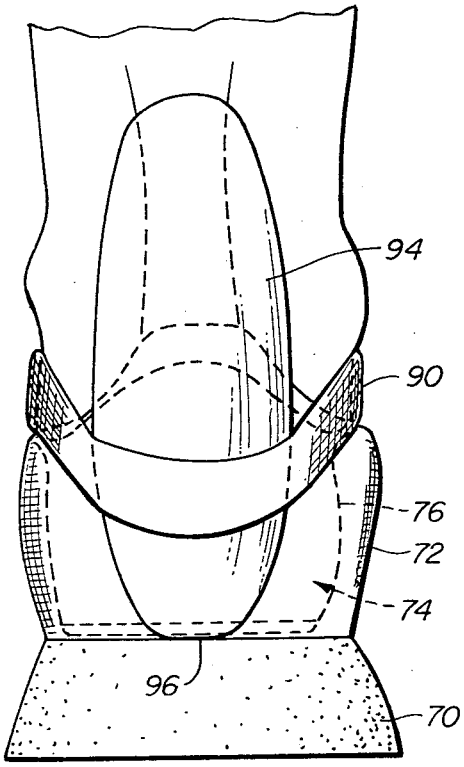
FIG. 6 is an end view of the shoe shown in FIG. 5.

When the user plantarflexes his foot, say during a heel strike when running, the lower leg 10 pivots rearwardly with respect to the foot. This correspondingly pivots bar 38 rearwardly about bolt 48. Guide bushings 56, 58 pivot in a relative rearward direction with the bar and since ring guide 54 is stationarily mounted to the upper 6, the length of cable between bolt 48, insert 30 and closure guides 60 on each side of the V-shaped cutout 12 is effectively shortened. This further closes the cutout, pulls the heel cup upwardly, as shown in FIG. 3 (although FIG. 3 shows a forward pivotal movement of the lower leg), and presses the heel cup against the user's heel with a force which increases with the degree of movement of the lower leg away from the neutral position. As a result, the tightness with which the shoe fits on the foot is increased and relative movements of the foot in the shoe are reduced or eliminated even though the forces that are exerted between them might be momentarily very high.

The same occurs when the user dorsiflexes the foot, that is when the lower leg 10 pivots forwardly with respect to the foot as is illustrated in FIG. 3, say during toe off. The lengths of cable between bolt 48, heel cup 30 and the V-shaped cutout 12 are again shortened because of the forward pivotal movement of bars 38 and of the guides 56, 58 attached thereto.

FIG. 3 also illustrates the manner in which the lifting of the heel cup 30 lifts footbed 32 of the insert. If the footbed is constructed of a flexible material, it primarily serves as an anchoring device for the insert within the shoe and will follow the foot upwardly with the heel cup without exerting any forces against the underside of the foot. To improve the manner in which the fit of the shoe is tightened when the foot is moved about its ankle joint, it is desirable to construct the footbed of a rigid material. In that event the footbed should terminate at about the ball of the foot and when the heel cup is drawn upwardly and forwardly by cable 52 an upwardly directed force is relatively evenly applied to the underside of the foot over substantially its full length. As a result, the increased force applied to the foot as it moves away from its neutral position is more evenly distributed, resulting in an improved and more comfortable fit of the shoe. By giving the footbed a rigidity which is about equal to the rigidity of the shoe sole 4 no discomfort is experienced by the user.

FIG. 4 illustrates the tightening of the fit when the user's foot moves laterally with respect to his lower leg 10 about ankle joint 22. During relative lateral movement of the foot, either inwardly or adduction (as shown) or outwardly or adduction (not shown) the cable guide bushings 56, 58 on the bar 38 located on the side of the foot to which it is pivoted relative to his lower leg are moved away from the shoe, pulling the associated cable 52 with them. This again shortens the effective lengths of the cable between bolt 48, heel cup 30 and guides 60 at cutout 12. The resulting increase in the force applied to insert 30 raises it upwardly, presses the foot against the upper 6 with greater force, and thus increases the tightness of the fit. The other bar 38, that is the one on the outside with respect to the direction in which the foot is moved laterally, points with the leg and may also bend slightly over its length without appreciably changing the length of the cable 52 associated with it. If the insert 26 is provided with a rigid footbed 32, the earlier discussed equalization of the increased pressure over a major portion of the user's foot is also achieved.

Referring now to FIGS. 5–8, in another embodiment of the present invention, a shoe 68 again has a sole 70 and upper 72. The upper may have a V-shaped cutout and conventional lacing (not shown) but preferably is of a one piece, continuous construction as shown. An insert 74 has a heel cup 76 constructed as above described and, preferably, a forwardly extending footbed 78 which again terminates in the vicinity of the ball of the user's foot. A relatively rigid instep tongue 80 is provided which fits over the instep of the user's foot and is defined by a lower tongue section 82 disposed primarily within the shoe, an upper tongue section 84 and a hinged joint 86 which interconnects the two and permits relative pivotal movement between them. The hinged joint may be a separate hinge or a flexible, integrally constructed connection between the two sections 82, 84 located at the center of the tongue. The tongue sections define between them opposing edges 88 which abut when the foot is in its neutral position and separate during forward flex of the leg with respect to the foot. During rearward lean of the leg (as illustrated in FIG. 7), the edges continue to abut.

Figure 5:
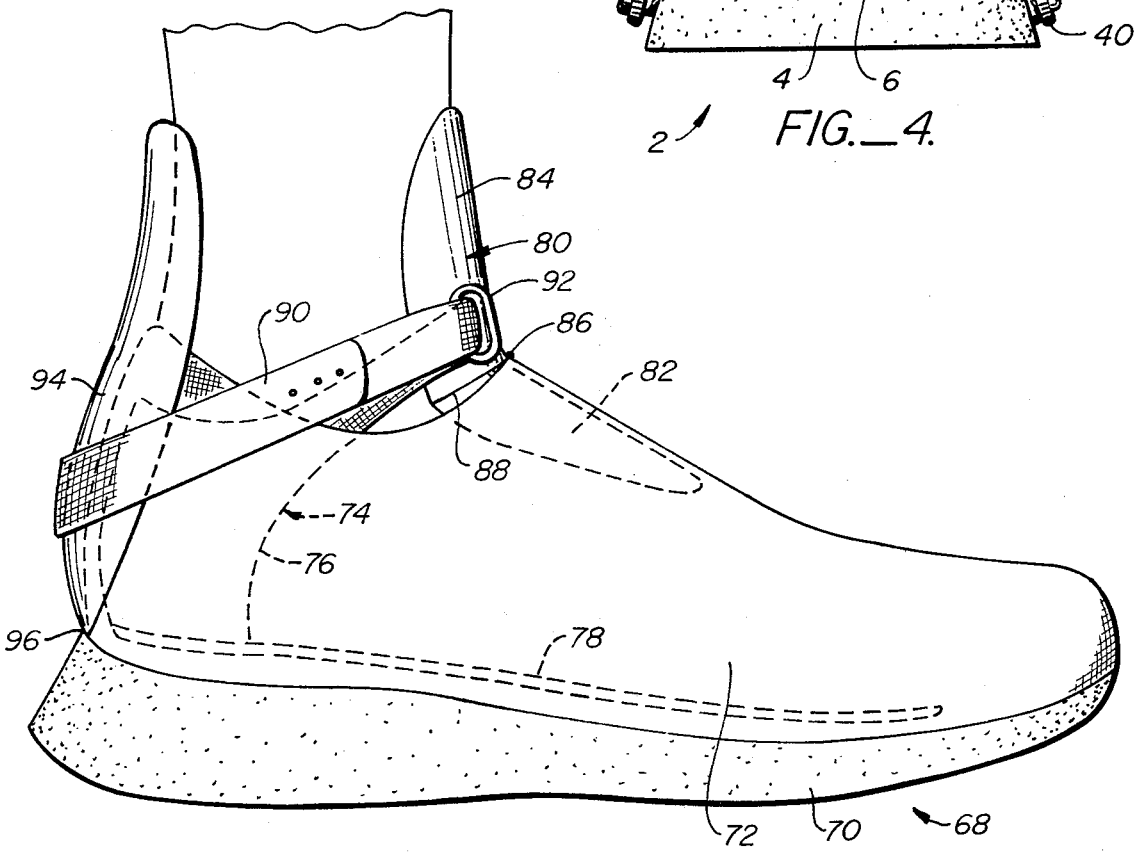
FIG. 5 is a view similar to FIG. 1 and shows another embodiment of the present invention.

A strap 90 forms part of the insert 74 and extends from the heel cup on each side of the user's foot in a generally forward and upwardly inclined direction through a ring guide 92 secured to the instep tongue 80 and hence rearwardly and generally downwardly about a relatively rigid heel tongue 94 placed over the heel of the sport shoe. The heel tongue can pivot relative to the shoe about its lower edge 96 and may be fitted with a hinged connection or, alternatively, may engage the upper edge of shoe sole 70 as is illustrated in FIG. 5. The heel tongue extends upwardly to about the height of the upper tongue section 84. Strap 90 includes a suitable adjustable fastener such as snaps or Velcro fasteners so that its overlapping ends can be secured to each other.

In use, and after strap 90 has been tightened, there is a normal, comfortable fit of the shoe on the wearer's foot when the foot is in its neutral position and the edges 88 of the instep tongue 80 abut. When the user's leg moves forwardly with respect to his foot, the upper tongue section 84 moves in a clockwise direction with respect to the lower section 82 (as seen in FIG. 5). This increases the distance between guide ring 92 and heel cup 76. The heel tongue 94, however, remains fixed since it is fully supported by the heel end of the shoe. As a result, the forward pivotal movement of the upper tongue section applies an increased force to the strap 90 and thereby an increased, generally upwardly and forwardly directed force to the heel cup which raises the heel cup and thereby presses the foot generally forwardly and upwardly against shoe upper 72, thereby increasing the tightness of the shoe on the user's foot and preventing relative movement between the shoe and the foot even when large forces act between them. Upon return of the foot to its neutral position, the upper tongue section 84 pivots in a counterclockwise direction back towards its neutral position, thereby reducing the forces on strap 90 and permitting heel cup 76 to return to its neutral position.

The advantages obtained from constructing footbed 78 of a substantially rigid material, as discussed above, are also attained in this embodiment of the present invention.

When the user's leg is pivoted rearwardly with respect to his foot, as shown in FIG. 7, the edges 88 of instep tongue 80 remain in mutual engagement and prevent the upper tongue section 84 from pivoting rearwardly past its neutral position. The rearward pivoting of the leg pivots the heel tongue 94 about pivot edge 96 rearwardly and thus increases the distance between guide ring 92 on the instep tongue and the heel tongue. This results in an increase in the force applied by strap 90 to heel cup 76 and raises the cup in the above described manner, together with any tongue attached thereto, to increase the tightness of the fit of the shoe until the foot is again returned to its neutral position.

Referring to FIGS. 9 and 10, in a simplified embodiment of the invention a shoe 98 again has a sole 100 and an upper 102 which may have conventional lacing 104 in the front for securing the shoe to the user's foot. A pair of generally parallel, upwardly extending actuating bars 106 are pivotally attached to the upper 102 with pivot pins 108. An upper end portion of the bar pivotally mounts a strap 112 which includes a suitable closure member such as a Velcro fastener at its ends for opening the strap and closing it about the user's ankle (not shown in FIGS. 9 and 10).

A lower end portion 114 of the bar is disposed on the side of the bar opposite from the pivot pin 108. A tightening strap 116 extends over the fore foot instep portion 118 of shoe upper 102, on each side of the shoe about a guide pin or pulley 120 located beneath the lower end of the actuating bar 106 and hence vertically upwardly to an attachment point 122 on the lower end portion 114 of the bar where the ends of the strap are suitably secured thereto as with a rivet, clamp or the like. The relative positions of the guide pin or pulley 120, the bar pivot pin 108 and the attachment point 122 are selected so that pivotal movement of the bar in either direction causes a lengthening of the strap section between the guide pin 120 and the attachment point.

In use, the foot is placed inside the shoe, the shoe lacing is closed in a conventional manner and ankle strap 112 is tightened about the user's ankle. When the foot is in its neutral position, the shoe fits comfortably. If the user moves his leg forwardly or rearwardly with respect to his foot, the strap length between guide pin 120 and attachment point 122 is increased. This leads to a corresponding increase in the force applied by tightening strap 116 to the fore foot-instep part 118 of the shoe, thereby tightening the fit of the shoe until the foot is moved back to its neutral position.

As an alternative to providing a separate tightening strap 116 the tightening strap may form part of the shoe lacing 104, that is the ends of the shoe laces extend to either side of the fore foot instep part 118 downwardly and rearwardly over guide pin 120 to bar attachment points 122. This alternative arrangement has the advantage of equalizing the increased pressure during movement of the foot away from its neutral position over a substantial segment of the shoe upper 102, particularly when the shoe laces extend through low friction lace guides or pulleys attached to the shoe (not separately shown).

I claim:

1. Apparatus for increasing the tightness of the fit of a shoe worn on the foot of a lower extremity when the foot moves relative to a remainder of the lower extremity away from a normal position of the foot, the apparatus comprising means for engaging a portion of the foot with a given tightness when the foot is in the normal position; and actuating means responsive to relative movement of the foot with respect to the lower extremity in first and second directions from the normal position and operatively coupled with the engaging means for increasing the tightness of the engaging means on the foot when the foot is in a position other than the normal position.

2. Apparatus according to claim 1 wherein the actuating means comprises means for increasing the tightness of the engaging means when the lower extremity moves in opposite directions.

3. Apparatus according to claim 2 wherein the actuating means comprises means for increasing the tightness of the engaging means when the foot is moved about the ankle joint in forward and aft directions.

4. Apparatus according to claim 2 wherein the actuating means comprises means for increasing the tightness of the engaging means when the foot is moved about the ankle joint in opposing lateral directions.

5. Apparatus for increasing the tightness of the fit of a shoe on a wearer's foot in response to movements of the foot relative to a remainder of the wearer's lower extremity comprising:

tightening means for applying a first force to the shoe which engages the shoe with the foot;

and actuating means operatively coupled with the tightening means for applying a second force thereto which is greater than the first force in response to movement of the foot relative to the remainder of the lower extremity in first and second, generally opposite directions;

whereby the closeness of the fit of the shoe on the foot is increased when the foot is moved in either the first or the second direction.

6. Apparatus according to claim 5 wherein the tightening means comprises a strap.

7. Apparatus according to claim 6 wherein the shoe has a sole and an upper attached thereto, and wherein the strap is formed to extend from the actuating means over the upper, whereby the second force increases the tightness with which the upper engages the foot.

8. Apparatus according to claim 6 wherein the tightening means further includes an insert for placement in the shoe and shaped to engage a portion of the foot including the heel.

9. Apparatus according to claim 6 or 8 wherein the actuating means includes a bar means adapted to be movably connected to the shoe for engaging a portion of the remainder of the lower extremity so that the bar means moves with respect to the shoe when the foot moves with respect to the remainder of the lower extremity.

10. Apparatus according to claim 9 including means for pivotally mounting the bar means to the shoe.

11. Apparatus for increasing the tightness of the fit of a shoe on a wearer's foot in response to movements of the foot relative to a remainder of the wearer's lower extremity comprising:

an insert for placement in the shoe and shaped to engage a portion of the foot including the heel;

tightening means for applying a first force to the insert which presses the insert against the foot;

and actuating means operatively coupled with the insert and the force applying means for applying to the insert a second force which is greater than the first force in response to movement of the foot relative to a remainder of the lower extremity in first and second, generally opposite directions;

whereby insert increases the closeness of the fit of the shoe on the foot when the foot is moved in either the first or the second direction.

12. Apparatus according to claim 11 including means for applying the second force to the insert when the foot is moved in generally opposite, third and fourth directions which are generally transverse to the first and second directions.

13. Apparatus according to claim 11 wherein the actuating means comprises means for engaging the lower leg of said lower extremity so that the second force is applied to the insert when the foot is moved about its ankle joint.

14. Apparatus according to claim 13 wherein the actuating means includes bar means attached to the lower leg engaging means; means for movably mounting the bar means to the shoe so that relative movement between the lower leg and the foot causes corresponding movements of the bar means with respect to the shoe, and means operatively coupled with the bar means and the insert for increasing the force applied to the insert when the bar means moves relative to the shoe.

15. Apparatus according to claim 14 wherein the means operatively coupled to the bar means and the insert comprises cable means having a first portion attached to the insert and a second portion adapted to be attached to the shoe, and means secured to the bar means and engaging the cable means so that relative movement of the bar means results in the application of the second force to the insert.

16. Apparatus according to claim 14 wherein the means for movably mounting the bar means to the shoe comprises means for pivotally mounting the bar means on the shoe.

17. Apparatus according to claim 17 wherein the last mentioned means universally movably mounts the bar means to the shoe.

18. Apparatus according to claim 11 wherein the insert comprises a heel cup engaging the heel.

19. Apparatus according to claim 18 wherein the insert comprises a sole extending from the heel cup and formed to be engaged by an underside of the foot during use.

20. Apparatus according to claim 19 wherein the sole is rigid.

21. Apparatus according to claim 18 wherein the actuating means includes cable means connected with the insert and being formed to be tightened over a front of the foot, and wherein the means for applying the first force includes means for stressing the cable means.

22. Apparatus according to claim 21 wherein the stressing means comprises an overcenter clamp adapted to be attached to the shoe.

23. Apparatus according to claim 21 including means for substantially immovably securing a portion of the cable means intermediate the insert and the stressing means to the shoe.

24. A shoe forming a comfortable close fit on the foot of a lower extremity when the foot is in a normal position and increasing the tightness of the fit when the foot is moved into another position comprising:

a sole and an upper attached thereto;

means for sensing a relative movement in the lower extremity;

and actuating means operatively coupled with the sensing means and the shoe for increasing the tightness of the fit of the shoe on the foot in response to a relative movement in the lower extremity when the foot moves in any one of a plurality of different directions away from its normal position.

25. A shoe according to claim 24 wherein the sensing means comprises bar means movably attached to the shoe and adapted to be connected to another part of the lower extremity so that the bar means moves relative to the shoe when the foot moves relative to said another part from its normal position in one of the directions, and wherein the actuating means includes means operatively coupled with the bar means and the shoe for increasing the tightness of the shoe on the foot in response to movements of the foot in one of the directions away from its normal position.

26. A shoe according to claim 25 wherein the means coupled with the bar means and the shoe comprises cable means attached to the shoe and the bar means.

27. A shoe according to claim 26 wherein a first portion of the cable means is attached to the bar means and a second portion of the cable means is attached to the upper in a region thereof overlying the fore foot.

28. A shoe according to claim 27 including means pivotally mounting the bar means to the shoe.

29. A shoe according to claim 28 wherein the first portion of the cable means is attached to the bar means at a point opposite the pivot means from the point where the bar means is connected to said another part of the lower extremity.

30. A shoe according to claim 28 including an insert in the shoe for engaging the foot, and including a third portion of the cable means connecting the bar means with the insert so that relative pivotal motion of the bar means increases the tightness of the fit by increasing a force with which the insert is pressed against the foot.

31. A shoe according to claim 30 wherein the first portion of the cable means includes a section arranged substantially concentrically about the pivot axis of the bar means, and including means for substantially immovably securing the section to the shoe, and means attaching the first portion of the cable means at locations intermediate the section and the second and third portions to the bar means so that pivotal movement of the bar means increases the force with which the insert and the upper are pressed against the foot to thereby correspondingly tighten the fit of the shoe on the foot when the foot is moved in one of the directions away from the normal position.

32. A shoe according to claim 31 including a stationary guide connected to the shoe, engaging the cable means and defining the transitions between the first and second and between the first and third portions, and wherein actuating the attaching means includes cable guides secured to the bar means and engaging the first portion, the cable guides being positioned and arranged so as to maintain a first segment of the first portion parallel to the bar means and to angularly incline a second segment of the first portion relative pivot to the bar means when the bar means is pivoted about the pivot axis thereby increase the forces acting on the insert and the upper.

33. A shoe according to claim 24 wherein the insert comprises a heel cup for engaging the heel of the foot.

34. A shoe according to claim 33 including means orienting the cable means between the first and third portions so that tension applied to the cable means applies a force to the insert which is generally forwardly and upwardly oriented with respect to the foot.

35. A shoe according to claim 34 wherein the insert includes a sole extending from the heel cup beneath the foot to about the ball portion of the foot.

36. A shoe according to claim 35 wherein the sole is flexible.

37. A shoe according to claim 35 wherein the sole is rigid.

38. A shoe according to claim 28 wherein the means for pivotally mounting the bar means comprises means for universally pivotally mounting the bar means so that the bar means can pivot relative to the shoe in opposite, forward and aft directions and in opposite lateral directions.

39. A shoe forming a comfortable close fit on the foot when the foot is in a normal position relative to a lower leg of the wearer and increasing the tightness of the fit when the foot is moved into another position comprising:

a sole and an upper attached thereto;

bar means mounted for pivotal movement with respect to the shoe, the bar means extending in an upward direction from the shoe a sufficient distance to engage the lower leg;

an insert in the shoe formed to engage at least part of an underside of the foot and movable with respect to the sole;

cable means connected with the bar means and the insert; and guide means connected with the shoe and directing the cable relative to the bar means and the shoe so that when the foot moves away from the normal position in any one of a plurality of different directions, a force is applied by the insert against the foot which increases the tightness of the fit between the foot and the shoe as the foot moves away from the normal position and decreases the tightness of the fit as the foot moves towards the normal position.

40. A shoe according to claim 39 wherein the guide means includes a first guide attached to the bar means.

41. A shoe according to claim 40 wherein the bar means comprises a tongue overlying an instep portion of the foot.

42. A shoe according to claim 41 wherein the tongue includes means for relatively immovably securing it to the upper at least when the shoe is on the foot, and a section movably attached to the last mentioned means, and wherein the guide means is secured to the section.

43. A shoe according to claim 42 wherein the shoe includes a heel end, and wherein the bar means includes a heel tongue movably attached to the heel section, and wherein the guide means includes means for engaging the cable means with the heel tongue.

44. A shoe according to claim 43 including means on the instep tongue permitting relative movement of the section in a first direction from the normal position and preventing relative movements of the section from its normal position in a second direction which is opposite the first direction, and means permitting movement of the heel tongue in the second direction from the normal position and preventing movements of the heel tongue in the first direction from the normal position.

45. A shoe according to claim 40 wherein the guide means includes a second guide attached to the shoe.

* * * * *